United States Patent [19]

Colli et al.

[11] Patent Number: 4,899,286

[45] Date of Patent: Feb. 6, 1990

[54] PROCESS FOR DETERMINING THE OPTIMUM WINDING SPEED, AS WELL AS THE OPTIMUM WINDING PARAMETERS FOR EACH TYPE OF YARN

[75] Inventors: Luigi Colli; Roberto Badiali; Nereo Marangone, all of Pordenone, Italy

[73] Assignee: Savio, S.p.A., Pordenone, Italy

[21] Appl. No.: 133,311

[22] Filed: Dec. 16, 1987

[30] Foreign Application Priority Data

Dec. 23, 1986 [IT] Italy ..... 22809

[51] Int. Cl.[4] ..... G06F 15/46; D01H 13/26; B65H 54/02

[52] U.S. Cl. ..... 364/470; 57/264; 242/35.5 R

[58] Field of Search ..... 364/470, 900, 921.1; 73/159, 160; 242/355 R, 35.5 A, 18 R, 45; 57/263, 264, 265, 13–19

[56] References Cited

U.S. PATENT DOCUMENTS

| | | | |
|---|---|---|---|
| 4,194,349 | 3/1980 | Lane | 57/265 |
| 4,294,416 | 10/1981 | Beckman | 242/35.5 R |
| 4,344,582 | 8/1982 | Rapp et al. | 364/470 X |
| 4,408,447 | 10/1983 | Sloupensky et al. | 364/900 X |
| 4,467,593 | 8/1984 | Araki | 57/264 X |
| 4,532,759 | 8/1985 | Bischofberger | 57/264 |
| 4,576,341 | 3/1986 | Matsui et al. | 242/35.5 A |

*Primary Examiner*—Joseph Ruggiero

*Attorney, Agent, or Firm*—Hedman, Gibson, Costigan & Hoare

[57] ABSTRACT

A process for determining the optimum winding speed to obtain greater productivity of an automatic coner machine fed with a certain type of yarn. Acceleration and braking values are optimized, as well as various production parameters of the devices along the path of the yarn. For example, the yarn tension, the slub catching level, and the amount and nature of the lubricant, or paraffin, applied to the yarn. The collection front of the machine is subdivided into various winding sectors. Each sector is preset, by means of a central microprocessor unit, to operate at a winding speed, and with operating parameters which are partially different from, and partially equal to, the operating parameters of the other sectors, according to a program pre-set in said central unit. The central microprocessor unit processes the data received from each individual sector, and compares them to each other to define and display the values of the operating parameters. This allows the highest productivity to be obtained in the yarn winding process.

3 Claims, 1 Drawing Sheet

PROCESS FOR DETERMINING THE OPTIMUM WINDING SPEED, AS WELL AS THE OPTIMUM WINDING PARAMETERS FOR EACH TYPE OF YARN

BACKGROUND OF THE INVENTION

The present invention relates to a process for determining the optimum values of the operating parameters on an automatic coner machine, in order to obtain a greater productivity in the winding process. Said operating parameters are those relating to the winding speed, the acceleration and braking values, the value of the tension of the yarn being collected, the slub catching level, and the amount and nature of the lubricant, or paraffin, applied to the yarn before it is collected in the cone form.

FIELD OF THE INVENTION

On a textile winding machine, e.g., an automatic coner machine, equipped with a number of winding stations which are close to one another the yarn is unwound from pirns and collected as a package of crossed turns, denominated as a "cone". This cone is used in subsequent processing steps.

Depending on the type and the count of the yarn, and the type of cone one wants to obtain, the operating parameters have different optimization values.

Thus, at each yarn change, it is necessary to preset the winding with new optimum values, in order to secure an acceptable quality and production rate.

The larger the increases in speed the production system allows, the cheaper are the production systems. For example, a fast winding, which does not penalize the quality, having small breakage rates, improves the productivity. Therefore, the operators will tend to operate at the maximum allowed winding speeds. However, the characteristics of the yarn and, in particular, its strength, limits the operating speed at values lower than those possible from a purely mechanical standpoint. Such limitations are to avoid alterations in the physical characteristics of the yarn. Thus, the selection of the winding speed is considerably important depending on the type of yarn to be processed. On the automatic coner machines with yarn crossing, the cylinder supplying the motion and the yarn-guide device constitutes single element of the machine. This is the grooved drum. This grooved drive cylinder, used to wind the yarn, drives the cone by friction. At winding start-up, and during the stopping brakings, the cone frequently undergoes sharp changes in speed. These cause disarrangements in turns, and considerable slippings between the forming cone and the drive cylinder. These turn disarrangements can easily generate faults in cone formation, which cause difficulties during the unwinding process operating downstream the cone winding. Therefore, often when the type and the quality of the winding are unsuitable for the use they are intended the cones must be re-wound. This rewinding increases the finishing costs. The slippings also damage the wound yarn by stressing the yarn and generating faulty yarn lengths. This causes yarn breaks during the unwinding processes downstream of the production cycle.

Those skilled in the art widely acknowledge that the cause of damage to the yarn, and of faulty windings, is in the selection of unsuitable values of acceleration and braking, for the type of yarn being wound.

The yarn tension value of the yarn being wound is considerably important in the winding, because the success of the winding largely depends on a proper selection thereof. Said selection is mainly based on the type of yarn being wound. In a similar way, the selection of the slub catching degree should be made depending on the type of yarn, and its count, to eliminate the irregularities in the yarn, which might constitute a defect in the finished product.

Another operating parameter to be selected is the amount of the lubricating substance, or paraffin which has to be deposited on the yarn. Said amount is mostly determined by the nature of the yarn being wound.

DESCRIPTION OF THE PRIOR ART

From the present state of the art, some empirical, or semi-empirical methods are known, which enable the operators to determine approximately optimum values for the previously described operating parameters, making possible a higher productivity of the machine, and at the same time safeguarding the quality of the product, which must fulfill the presently adopted standards. Since the operator cannot know the values of the above described parameters, he must from time to time conduct experimental tests according to the type of yarn. From the practical view point of the user, the yarn is wound, throughout the winding front of the machine at a speed determined on the basis of empirical criteria.

The operator will then increase or decrease the winding speed, and at the end of the experimental tests the results will be compared with one another.

Sometimes, on the contrary, the quality of the yarn wound on the cone must fulfill certain requisites, so that the operator must proceed to process the yarn a plurality of times, each time with different operating parameters.

The process according to the present invention makes the times necessary for the experimental tests to be considerably minimized. In fact, it is possible to make the different winding sectors operate at speed braking and acceleration values, which are different between sectors, with the other operating parameters being kept constant according to a program present in the central microprocessor unit.

At the end of the planned experimental tests, the productivity results obtained from the various winding tests are compared to one another, and the same central processing unit identifies and displays the values of the operating parameters of that winding sector identifying where the greatest productivity in the yarn winding process was achieved. Then, the whole operating front is prearranged to operate, by means of the central processing unit, with the optimized values of speed, acceleration and braking as obtained from the previous tests, while the other working parameters, such as the yarn tension, the slub catching degree, the amount and the nature of the paraffin, are changed, individually or by groups, from sector to sector, always proceeding gradually, in order to define their optimum value.

The central microprocessor unit displays, at the machine head, all of the values of the operating parameters which are preset during the experimental tests in the various winding sectors. After the processing of the data, it displays the production results, indicating the optimum values, according to a preset program, of the individual operating parameters.

SUMMARY OF THE INVENTION

The purpose of the present invention is to overcome the above-said drawbacks.

In accordance with such intended purpose, the present invention is concerned with a process for determining the optimum values of the operating parameters in an automatic coner machine, in which the whole winding front of the individual machine is subdivided into various winding sectors each of said sectors being constituted by at least one winding unit. The speed, the acceleration and the braking values are preset, by means of a central microprocessor unit installed at the machine head, and are different values from sector to sector. The same value is preset for each of the other processing parameters for all of said winding sectors. By means of the central processing unit, the data received from each individual sector are processed, and compared with one another, to define and display the values of the speed, and the values of acceleration and of braking, to enable the best productivity to be obtained in the yarn winding process.

According to a form of a practical embodiment of the process of the present invention, the values of the other operating parameters are also optimized on the basis of the optimized speed, acceleration and braking values.

Such other parameters are, for example, those relating to the value of the tension of the yarn being wound, to the slub catching degree, and to the amount and nature of the lubricant, or of the paraffin, applied to the yarn before it is coned.

BRIEF DESCRIPTION OF THE DRAWINGS

The present invention is now disclosed by referring to the hereto attached drawing table, wherein.

In the Figures.

Figure 1:
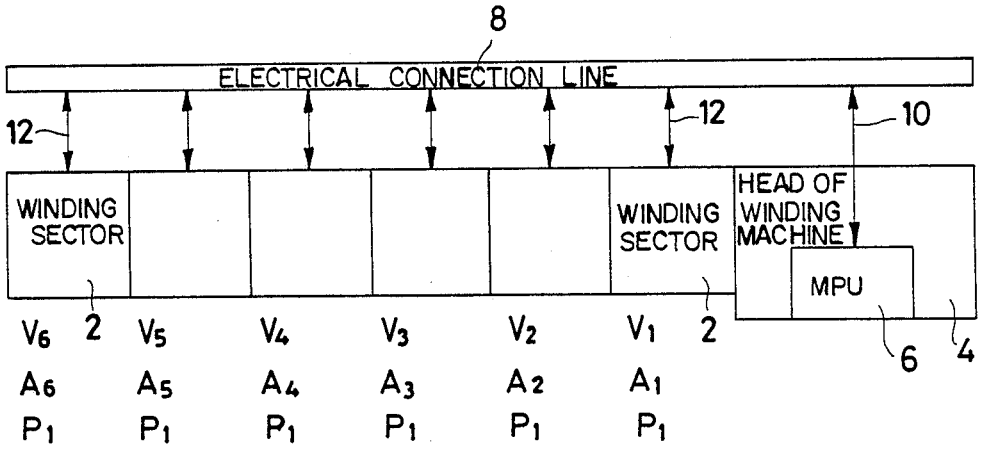
FIG. 1 is a plan diagram of an automatic coner machine, subdivided into a plurality of winding fronts.
Figure 2:
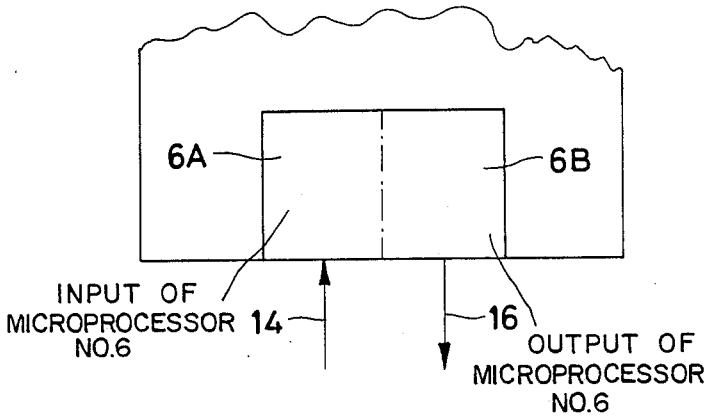
FIG. 2 is a partial diagram of the machine head, containing the central microprocessor unit, characterized in that it is provided with an input section, in order to acquire the input parameters, and with an output section, in order to supply the data, after the processing, according to a pre-established program.

2 is a winding sector of the machine front, constituted by one or more winding unit(s);

4 is the head of the winding machine, wherein the various devices and the various common drive sources of the whole operating winding front are collected;

6 is the central microprocessor unit, located in the head of the winding machine 45, schematically subdivided into the input section 6A and output section 6B;

8 is the electrical line of connection and communication between the various winding sectors 2 and the central unit 6;

10 is the length of electrical line connecting the electrical data transfer line 8 with the central processing unit 6;

12 is the length of electrical line connecting a winding sector 2 with the electrical data transfer line 8; is the symbol representing the data input devices, used to enter the parameter values in the central unit prearranged to acquire the input parameters;

16 is the symbol representing the data output devices of the central unit prearranged to supply the data, after the processing, according to a pre-established program.

DESCRIPTION OF THE PREFERRED EMBODIMENT

The operation of the process according to the present invention is now disclosed.

Initially, the operation of coning of a new yarn batch is preset, in the input section 6A of the central processing unit 6, via a keyboard or preselectors 14. The value of speed "V", and the values of acceleration and of braking "A" which are different for the various winding sectors 2 are entered, and the values of the other operating parameters are also entered, a same value being adopted for all of said winding sectors 2. Furthermore, the value of the length (meters) of yarn to be wound on the cones, and the maximum number of cycle repetitions which all of the winding unit shall perform, are entered as well.

The command of start-up of the coner machine is supplied, and the coner machine starts the winding operation throughout its winding front. This latter is subdivided into the various winding sectors 2, each of which operates on the basis of its operating parameters, a part of which are different from, and a part of which are the same as, those of the other winding sectors 2, according to the program. This is according to the values entered in the input section 6A of the central processing unit, as above disclosed.

The central processing unit 6, by electrical connecting line 10 and 12, and by the electrical connecting and communication line lengths 8, receives from the individual winding sectors 2 the whole set of production data necessary to compute the amount by weight, or the lengths, in meters, of yarn actually wound on the cones. The data is received from each winding sector, moment by moment, or in initially prefixed time intervals. This does not include the number of slub removals, or the number of carried out knotting cycles, or the number of carried out knots or junctures, or the number of stops, with the relating stand-by time of the winding heads.

The central control unit 6 processes, by means of a dedicated program, the production data relevant to each winding sector 2, to compute the amount of yarn wound in each one of the winding sectors, by weight or by length, together with the general winding yield reached by each of the winding sectors.

All the data are displayed on a display peripheral, and/or on a printer 16 provided in the data output section 6B, upon a request for display entered by the attending operator. A variant can be preset as well in the dedicated program run by the central processing unit 6 that, when a prefixed time interval expires, a sound signal, or a light signal, is enabled, to draw the attention of the attending operator, that the received data has been processed and the output parameters are ready for display.

Once the operator has learned the data relevant to the highest-productivity winding sector, he can enter this date in section 6A of the central processing unit 6 to make the data uniform throughout the winding sectors 2 of the winding operating front to operate the machine under the new operating conditions.

We claim:

1. A process of determining the optimum values of operating parameters of an automatic coner machine, comprising:

(a) subdividing the winding front of the automatic coner machine into various winding sectors wherein each of said sectors includes at least one winding unit;

(b) presetting the values of operating parameters for the speed, acceleration, and braking different from winding sector to winding sector by means of a central microprocessor unit;

(c) presetting the same value of the remaining processing parameters for all of said winding sectors; and (d) receiving and comparing the data from each of said winding sectors with each other by said central microprocessor unit for defining and displaying said speed, acceleration, and braking values for achieving high yarn winding productivity.

2. The process of claim 1 further comprising setting the values of said remaining processing parameters on the basis of the optimized values of the speed, acceleration, and braking.

3. The process of claim 2 further comprising setting values of the yarn tension, the slub catching degree, the amount and nature of lubricant, or the amount of paraffin deposited upon the yarn prior to winding.

* * * * *